US006935531B1

(12) United States Patent
Clayton

(10) Patent No.: US 6,935,531 B1
(45) Date of Patent: Aug. 30, 2005

(54) TOY WATER GUN

(76) Inventor: Richard A. Clayton, 71 Humboldt St., Simi Valley, CA (US) 93065

( * ) Notice: Subject to any disclaimer, the term of this patent is extended or adjusted under 35 U.S.C. 154(b) by 15 days.

(21) Appl. No.: 10/178,295

(22) Filed: Jun. 24, 2002

Related U.S. Application Data

(60) Provisional application No. 60/301,034, filed on Jun. 25, 2001.

(51) Int. Cl.[7] ..... A63H 3/18; B65D 88/54

(52) U.S. Cl. ..... 222/79; 222/401; 222/330; 239/443

(58) Field of Search ..... 222/79, 401, 330; 239/443, 446

(56) References Cited

U.S. PATENT DOCUMENTS 2,589,963 A * 3/1952 Richardson ..... 222/79
3,202,318 A 8/1965 Black
5,439,139 A * 8/1995 Brovelli ..... 222/79
5,730,325 A * 3/1998 Cheung ..... 222/79
5,829,635 A * 11/1998 Brovelli ..... 222/39
6,151,824 A * 11/2000 Clayton ..... 42/54
6,279,562 B1 * 8/2001 Clayton ..... 124/59
2002/0016127 A1 * 2/2002 Skinner et al. ..... 446/176

FOREIGN PATENT DOCUMENTS

DE 3124125 * 1/1983 ..... B05B 7/02

OTHER PUBLICATIONS

U.S. Appl. No. 60/212,118, Skinner.*

* cited by examiner

*Primary Examiner*—Michael Mar
*Assistant Examiner*—Patrick Buechner

(57) ABSTRACT

A toy water gun provides a plurality of nozzles for discharging water in a variety of directions, volumes or spray patterns. A multi-position trigger or similar device controls selection of nozzles individually or in combinations whereby an operator can quickly choose among various modes of discharge by moving the trigger through corresponding positions.

72 Claims, 10 Drawing Sheets

TOY WATER GUN

This application is related to applicant's prior provisional application Ser. No. 60/301,034, filed Jun. 25, 2001, titled Toy Water Gun. The specification of said provisional application is incorporated herein by reference. Applicant hereby claims benefits of said prior provisional application under 35 U.S.C. 119(*e*).

BACKGROUND OF THE INVENTION

The invention relates to toy water guns, and more particularly to such water guns having multiple nozzles for discharging water, and water guns in which nozzles are adapted to discharge in directions other than forward.

Water guns are well known in which a plunger or trigger is employed to force or release water through an internal passage leading to a rotatable nozzle head having several orifices of various sizes or shapes. Thus, an operator may, in between discharges, rotate the nozzle head to align a selected orifice with the water passage, for different choices of discharge volume or spray patterns. While such designs allow many choices to be available, the configuration is not conducive to quick or repeated changes, particularly in the midst of a water battle.

U.S. Pat. Nos. 4,615,488 and 4,597,527 (both to Sands) disclose water guns in which a member of a nozzle head assembly is rotated to selectively align either a forward nozzle or a sideways directed nozzle with a main water supply passage. Additionally, a second member of the nozzle head (or the plunger handle of an alternate embodiment) may be rotated to allow flow of water from the main supply passage to a pair of rearward facing nozzles. To select a new output configuration an operator must presumably halt the process of discharging water to perform a separate nozzle selection operation. The rearward nozzles are intended to direct water at the operator of the gun, rather than at a target located behind the operator (U.S. Pat. No. 4,597,527, col. 2, lines 43–46 and col. 3, lines 22–26).

U.S. Pat. No. Re. 24,208 (Steiner), U.S. Pat. No. 2,888,172 (O'Brian), U.S. Pat. No. 3,146,911 (Shun), U.S. Pat. No. 4,492,318 (Luk), U.S. Pat. No. 5,244,153 (Kuhn et al.) and U.S. Pat. No. 5,427,320 (Mak et al.) all disclose water guns in which a movably mounted single nozzle is manipulated by the operator to point in different directions. U.S. Pat. No. 6,151,824 (Clayton) discloses a water gun in which multiple movable nozzles can simultaneously discharge in different directions.

U.S. Pat. No. 819,602 (Rupp) discloses an agricultural sprayer in which two spray heads can discharge fluid. The device does not simulate a firearm, is attached to a hose (col. 1, In. 23–25) and is carried by holding the arms 10, one in each hand (col. 2, In. 74–77). U.S. Pat. No. 979,771 (Kunzelmann) discloses a nozzle head in which a handle is employed for selecting one of three nozzles. The handle changes the orientation of the nozzles so that a selected nozzle always aims forward. U.S. Pat. No. 5,603,361 (Cuisinier) discloses a water pistol in which a second output can be selected and employed for filling a water balloon. The second output points straight down along a vertical axis with respect to the pistol. U.S. Pat. No. 5,735,440 (Regalbuto) shows a bicycle mounted squirting apparatus with multiple nozzles. The apparatus does not simulate a firearm and is not practical for use without a bicycle, upon which its major components must be separately and individually mounted.

SUMMARY OF THE INVENTION

The invention provides novel water gun control means for quick and easy selection of different nozzles or combinations thereof, so that discharge direction, volume and/or spray patterns may be changed "on the fly" without significant down time or interruption of discharge during changes in selection. In a typical embodiment, a water gun has an internally carried discharge control valve with multiple selectable outputs. Each valve output is connected via conduit to a different nozzle or set of nozzles. A multi-position trigger or similar device controls the valve, whereby an operator can choose among the various modes of discharge simply by moving the trigger among corresponding positions.

DESCRIPTION OF EXEMPLARY EMBODIMENTS

Figure 1:
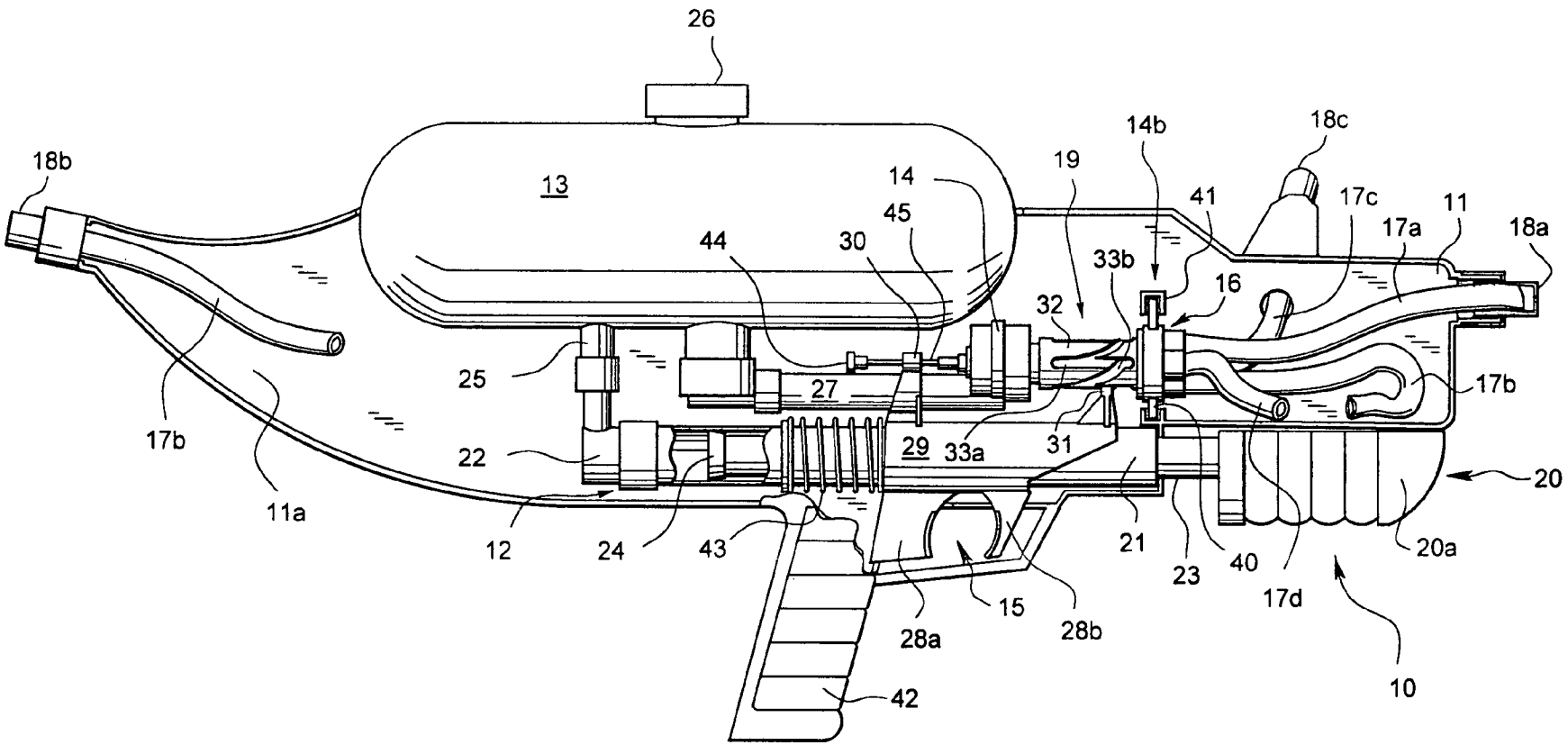
FIG. 1 is a side view in partial section of a water gun having a trigger controlled multiple output rotary valve for selection of front, rear and side nozzles.
Figure 2:
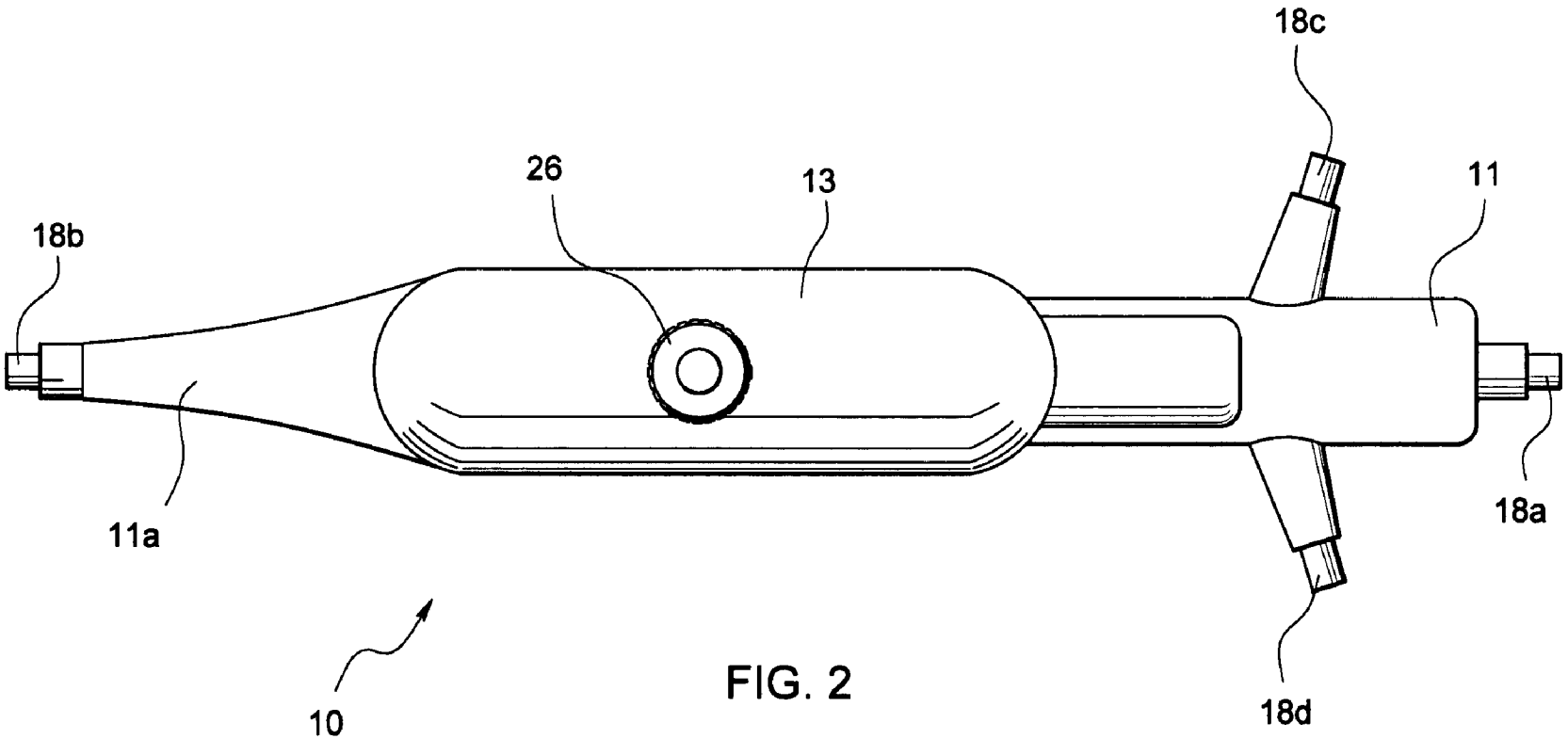
FIG. 2 is a top view of the water gun of FIG. 1.
Figure 3:
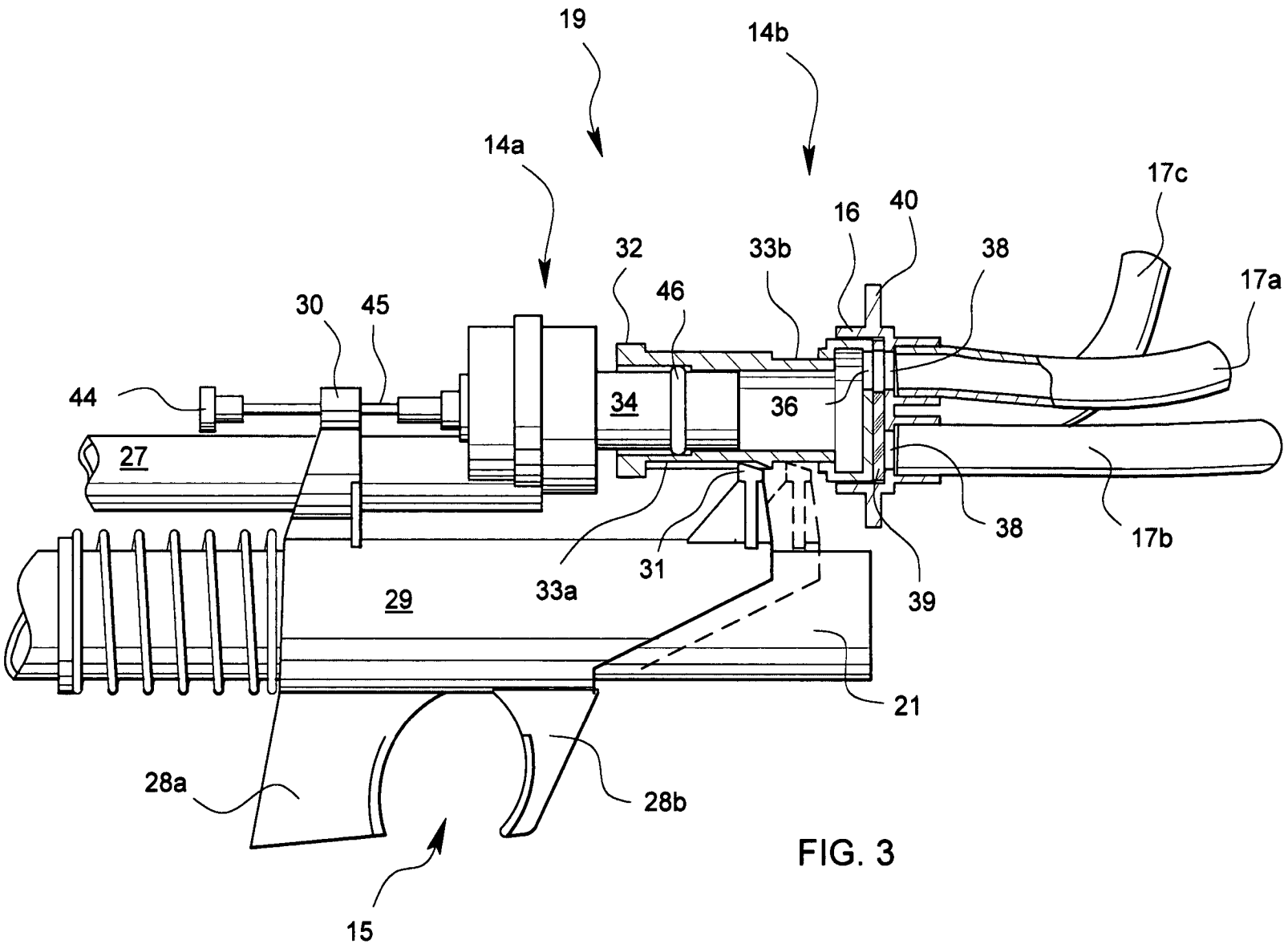
FIG. 3 is a side view in partial section of the valve and trigger mechanisms of FIG. 1.

FIGS. 1, 2 and 3 depict, by way of illustration but not of limitation, a water gun employing the present invention. The water gun 10 includes a body or frame 11, a pump 12 adapted for pressurizing water and air in a sealed reservoir 13, a valve 19 for releasing pressurized water from the reservoir, and a trigger assembly 15 for operating the valve. The pump 12 includes a plunger 20, a cylinder 21 and a unidirectional check valve 22. The plunger includes a shaft 23 having a piston 24 at one end and a user operable handle 20*a* at the opposite end. Reciprocation of the plunger 20 within the cylinder 21 draws outside air into the cylinder as the plunger is moved to the right in FIG. 1, and forces said air through check valve 22 and into reservoir 13, via conduit 25, when the plunger is moved to the left. Water is added to the reservoir (when not pressurized) through an air tight removable cap 26. Air pressure urges water from the reservoir 13 to the valve 19 via a tube 27.

The valve 19 (ref. FIG. 3) includes a first stage 14*a* for allowing or blocking the flow of water, and a second stage 14*b* for selecting discharge direction. A tube 34 supplies water from the first valve stage 14*a* to the second stage 14*b*, which includes a movable cylindrical core 32 carried for rotation in a body 16 having four output ports 38. The body 16 is held in fixed position on the gun frame 11 by engagement of tabs 40 and receptacles 41, and may be integrally connected with the body of first valve stage 14*a* (for simplicity of illustration such connection is not shown in the figures). The output ports 38 are radially offset from the axis of rotation of the core 32, symmetrically spaced from each other by ninety degrees. The rotary core 32 has a single aperture 36 radially offset from the axis of rotation such that it can be aligned with any selected one of the outputs 38. An o-ring 46 and feed-through gasket 39 restrict leakage about the core 32 where it interfaces with tube 34, and valve body 16. The gasket 39 is affixed to the core 32 and rotates with same to allow passage of water between aperture 36 of the cylinder and a selected output port 38. Conduits 17*a, b, c* and *d* connect the valve outputs 38 to nozzles 18*a, b, c* and *d*, respectively. Thus, water will be discharged in the forward, reverse, left or right directions respectively, depending upon with which port 38 the core aperture 36 is aligned. An elongated frame extension 11*a* supports the rear nozzle such that the extension 11*a* is normally tucked under an operator's "trigger arm" and the nozzle 18*b* is directed to the rear of, rather than at the operator. The rear nozzle 18*b* is angled upward to compensate for the typical tendency of an operator to angle the forward end of a water gun upward, and hence to angle the rear end downward. Right nozzle 18*c* and left nozzle 18*d* may also be angled slightly upward, to enhance the projection of water in both directions.

The frame 11 includes a pistol grip 42 so that an operator may hold the gun in one hand and actuate the trigger 15 with the index finger of that hand. The trigger 15 includes first and second finger operated members 28*a* and 28*b*, a tubular sleeve 29 which slides in forward and reverse directions about pump cylinder 21, a discharge actuating member 30, and an output selection cam 31 which engages slots 33*a* and 33*b* in the rotating cylindrical core 32 of the valve 19. A spring 43 normally biases the trigger 15 forward to the position shown in solid lines in FIG. 3. To discharge water from a currently selected output an operator pulls trigger member 28*a* toward the rear of the gun, from said position. Cam 31 slides in one of the longitudinally aligned grooves 33*a* and imparts no motion to the core 32. Discharge actuating member 30 slides along a valve opening control rod 45 until it engages a flange 44; further rearward motion of trigger 15 pulls the control rod 45 rearward to open first valve stage 14*a*, which releases water from tube 27 into tube 34, and thus into second valve stage 14*b*, where it flows through aperture 36 and a selected port 38, to be discharged through a corresponding nozzle.

To change the selected output an operator pushes forward on second trigger member 28*b* so that cam 31 moves forward into one of the diagonally oriented grooves 33*b*, as depicted by dashed lines in FIG. 3. The operator then pulls rearward on first trigger member 28*a* whereby engagement of cam 31 with groove 33*b* forces the cylinder 32 to rotate by 90 degrees, whereupon the cam 31 enters the next longitudinal groove 33*a*. At such position discharge actuating member 30 will not have engaged flange 44 of the valve control rod 45, so no water is released. The operator may now either pull first trigger member 28*a* farther back to release water from the newly selected output, or he may push forward again on second trigger member 28*b* to engage cam 31 with the next diagonal groove 33*b* to initiate another incremental rotation of cylinder 32, and thus another change in output selection. From a given output selection, any other output can be selected through no more than three reciprocations of member 28*b* as described above.

Referring to FIG. 3, it may be seen that the valve outputs 38 are mutually exclusive, i.e., only one output can be selected at any given time, since rotary aperture 36 can be aligned with only one of the outputs 38 at a time. If construction of alternate embodiments, any of the outputs may be connected via conduit to a group of nozzles (front, right and left nozzles, for example) such that simultaneous multi-directional discharge results when that particular valve output is selected. Group connections aside, the valve and trigger structure 19, 15 is additionally and particularly useful in other embodiments where the selection of individual (as opposed to groups of) nozzles is desired. For example, each of the four valve outputs 38 may be connected through separate conduits to four separate forward facing nozzles, where each of the nozzles is of a different orifice size or shape. Thus, the trigger may be used to quickly select among four different discharge volumes or spray patterns.

Figure 4:
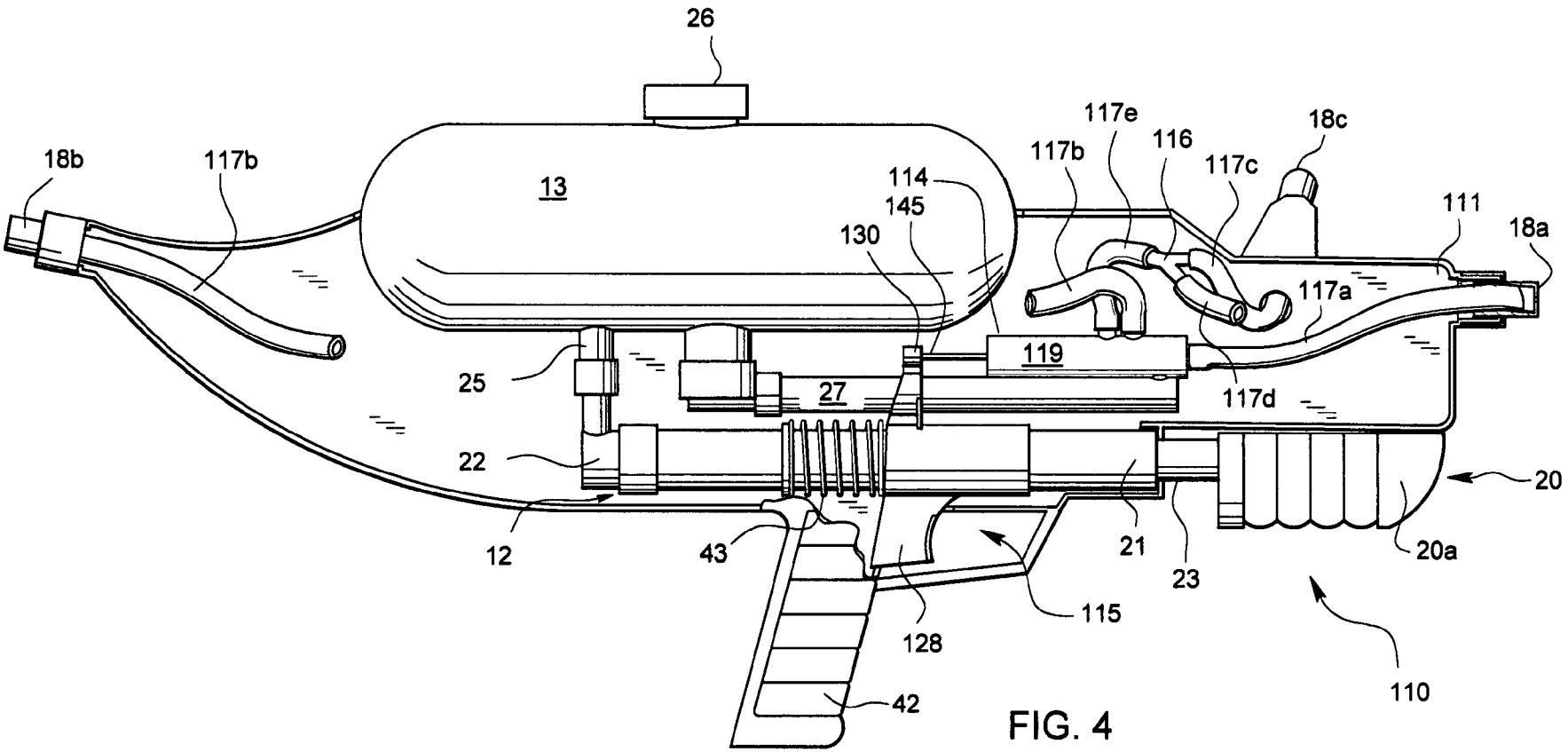
FIG. 4 is a side view in partial section of a water gun having a trigger controlled multiple output linear valve for selection of front, rear and side nozzles.
Figure 5:
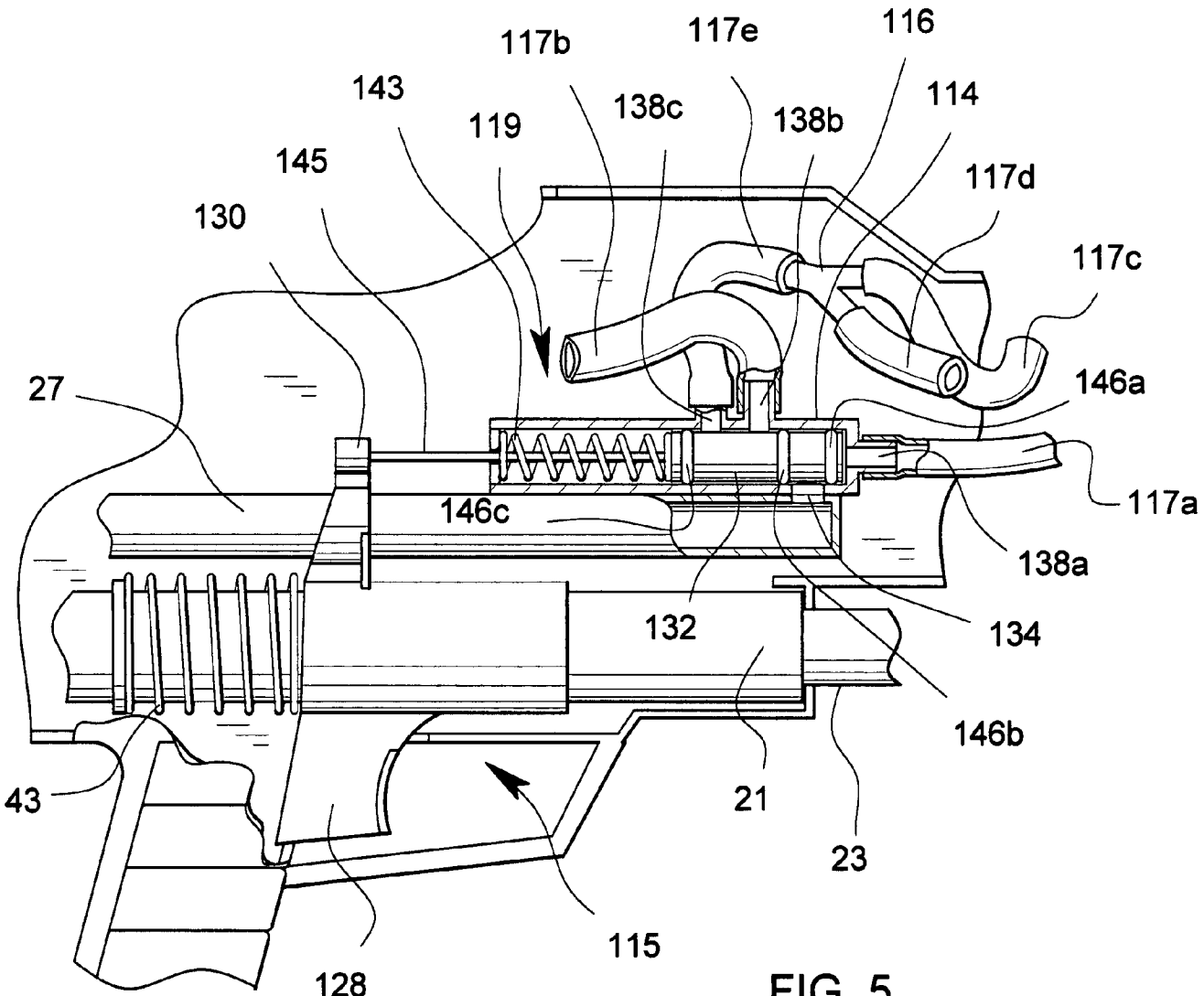
FIG. 5 is a side view in partial section of the valve and trigger mechanisms of FIG. 4.

FIGS. 4 and 5 illustrate another water gun 110 incorporating the present invention. Other than the trigger and valve mechanisms, water gun 110 is identical to the gun 10 of FIG. 1 and similar items are identically numbered. Water gun 110 includes a frame 111, a valve 119, and a trigger assembly 115 that slides back and forth on air pump cylinder 21 and pressurized water supply tube 27. The trigger assembly includes a finger actuated member 128 and a valve control member 130. The control member is in fixed engagement with a valve control rod 145 such that forward or backward movement of the trigger 115 is matched by movement of the control rod 145 and a valve plunger 132 (ref. FIG. 5). The valve plunger is movably carried within a valve body 114. A trigger return spring 43 and a valve spring 143 bias the trigger 115 and valve plunger 132 to the forward position depicted in FIG. 5. Pressurized water is supplied by tube 27 to the valve 119 through an interconnecting passage 134. With valve plunger 132 positioned as in FIG. 5, o-rings 146*a*, 146*b* prevent flow of water from passage 134 to valve output ports 138*a, b, c*.

The valve outputs 138*a–c* are not mutually exclusive, and are sequentially enabled. To initiate water discharge, an operator pulls rearward on trigger member 128 until o-ring 146*a* becomes positioned to the rear of passage 134, at which point water flows from passage 134 into valve body 114 and through valve output port 138*a*. A conduit 117*a* connects port 138*a* to nozzle 18*a* for discharge in the forward direction. If the operator continues to pull the trigger rearward such that o-ring 146*a* passes to the rear of valve output port 138*b*, water will flow through both conduits 117*a* and 117*b*. Conduit 117*b* connects port 138*b* to rear nozzle 18*b*, so the water gun will discharge simultaneously in the front and rear directions. If the trigger is pulled still farther back, such that o-ring 146*a* is positioned to the rear of valve output port 138*c*, water will flow to all three output ports simultaneously. Output 138*c* is connected to right nozzle 18*c* and left nozzle 18*d* through conduits 117*c, d, e* and splitter 116. Therefore, with the trigger 115 pulled to its rearmost position, water will discharge from the front, rear, right and left nozzles 18*a–d* simultaneously. A third o-ring 146*c* prevents the draining of water from conduits 117*b* and 117*e* through valve body 114, around spring 143, when the plunger is returned to its forward position (as in FIG. 5).

Figure 6:
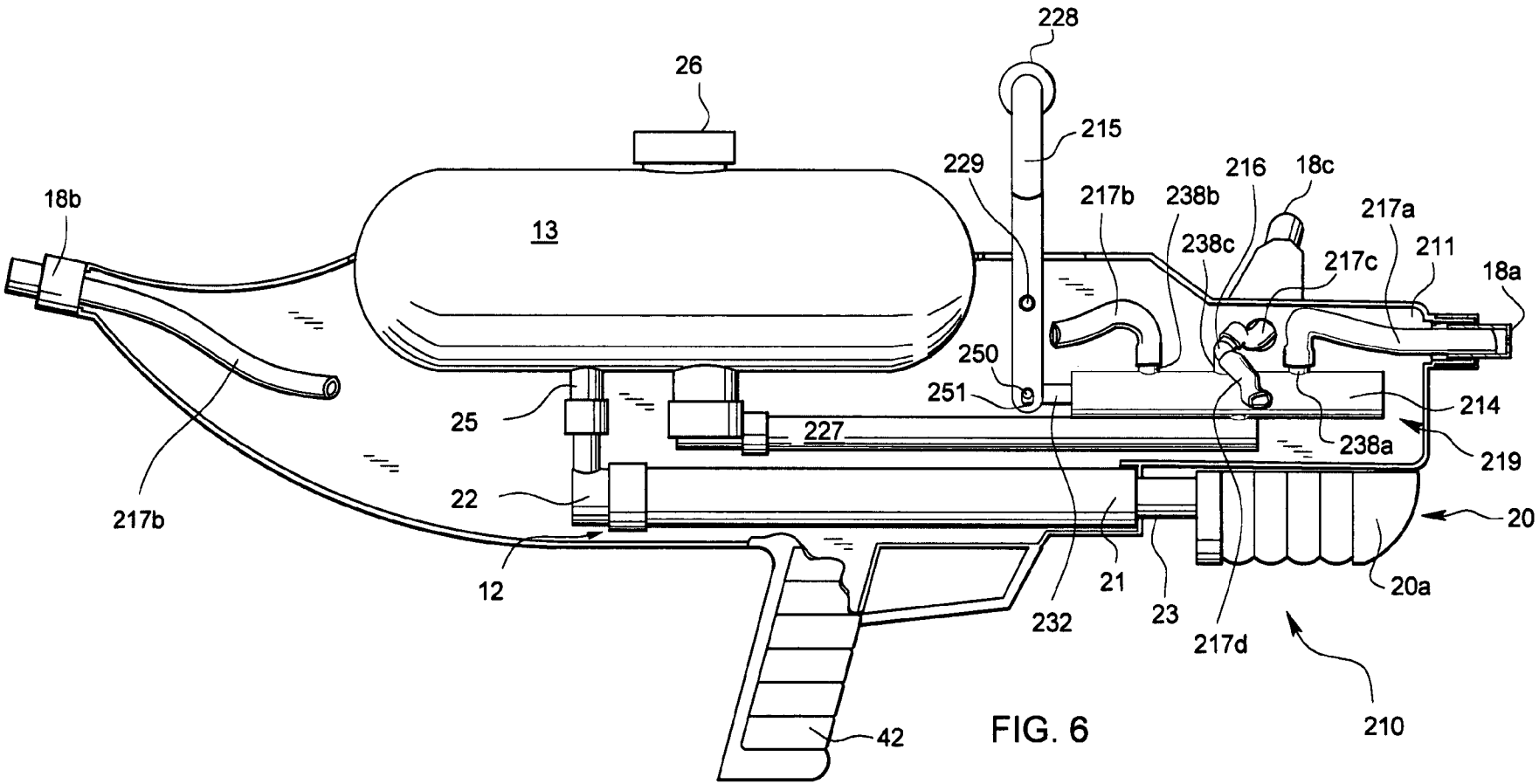
FIG. 6 is a side view in partial section of a water gun having a top mounted trigger that controls a multiple output linear valve for selection of front, rear and side nozzles.
Figure 7:
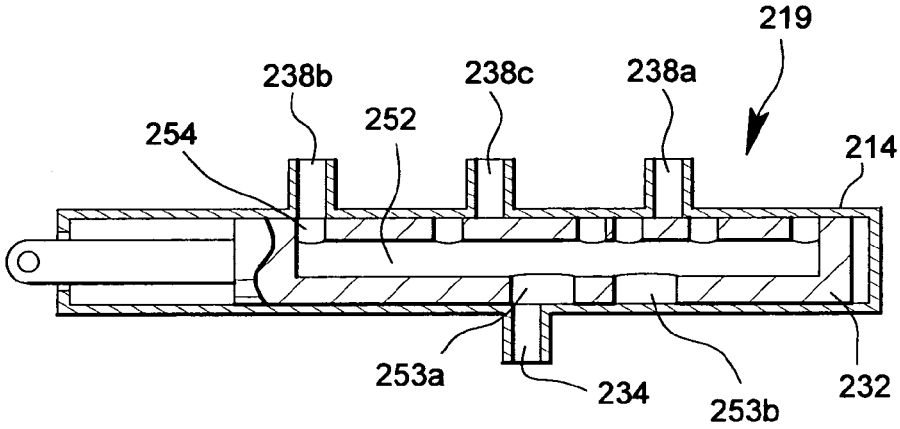
FIG. 7 is a side view in partial section of the valve of FIG. 6.

Another water gun 210 incorporating the present invention is depicted in FIG. 6. Other than the trigger and valve mechanisms, water gun 210 is identical to the gun 10 of FIG. 1 and similar items are identically numbered. The water gun 210 includes a frame 211, a valve 219, and a top mounted "fire hose" styled trigger lever 215 carried for pivotal movement about a pin 229. The trigger 215 includes an operating handle 228, and is operably connected to a valve plunger 232 via a pin 250 on the plunger that engages a slotted hole 251 on the trigger 215. The plunger 232 is carried for sliding motion within a valve body 214, such that forward and reverse pivoted movement of the trigger 215 causes the plunger to linearly slide back and forth within the valve body 214. The valve body includes a plurality of outputs 238*a–c* connected to front, rear, left and right nozzles 18*a–d* via conduits 217*a–d*, respectively. Output 238*c* is connected to both the left and right conduits 217*c*, 217*d* by a splitter 216. The valve 219 is supplied with pressurized water through an input port 234 (ref. FIG. 7) which mates with a radially positioned aperture (not shown) near the forward end of water tube 227.

Figure 8:
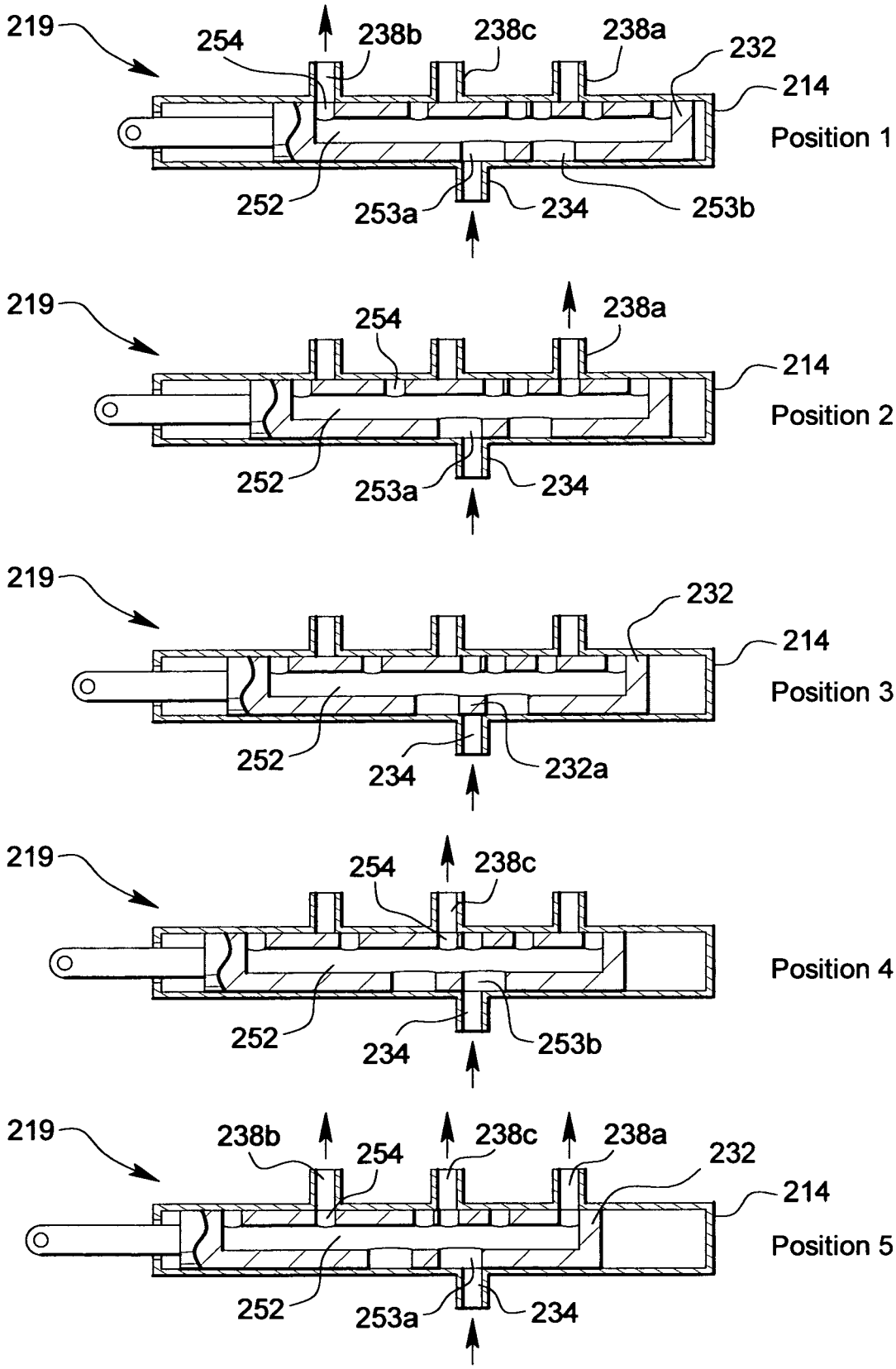
FIG. 8 is a side view in partial section of a modified valve similar to that of FIGS. 6 and 7.

The plunger 232 is constructed with an internal longitudinal passageway 252 which can be connected to the input port 234 through either of two elongated radial passages 253*a*, 253*b*, and which can be selectively connected to the output ports 238*a–c*, either individually or in programmed combinations, through six radial passages 254. The valve has five operating modes which depend upon the incremental positioning of plunger 232 within valve body 214. With reference to FIG. 8, the five operating modes are illustrated in relation to the plunger position. In the orientation labeled "Position 1", the plunger is placed in its most forward possible position (forward being to the right in the figures). Successive labeled positions correspond to incremental rearward movements of the plunger.

With the plunger 232 in Position 1 of FIG. 8, water is allowed to flow from input 234 through the central passage 252, and out through leftmost port 238*b*. Referring to FIG. 6 it is seen that port 238*b* connects to rear nozzle 18*b*, via conduit 217*b*, so that Position 1 of the plunger corresponds to rearward discharge. With reference to FIGS. 6 and 8 it may be further understood that Position 1 of the plunger will correspond to the trigger handle 228 being pulled to it's most rearward possible position so that the lower end of trigger lever 215 is pivoted fully to the right.

Again referring to FIG. 8, the plunger 232 in Position 2 will allow water to flow from input 234 to output 238*a*, which corresponds to forward discharge through nozzle 18*a*. The corresponding position of trigger handle 228 (FIG. 6) will be partially rearward.

In Position 3, a solid portion 232*a* of the plunger covers input port 234 so that water flow is prevented. This is an "OFF" mode and corresponds to trigger lever 115 being in the vertical orientation as shown in FIG. 6. Gaskets, o-rings or similar devices may be incorporated to enhance sealing between the plunger 232 and valve body 214.

Position 4 of plunger 232 allows water flow from input 234 to output 238*c*, which corresponds to left and right simultaneous discharge from nozzles 18*c* and 18*d*, via conduits 217*c* and 217*d*. The trigger handle 228 will be positioned partially forward.

Position 5 of the plunger simultaneously aligns one of the upper plunger passages 254 with each of the outputs 238*a–c*, so that water flows to all four nozzles for simultaneous front, rear, left and right discharge. Trigger handle 228 of FIG. 6 will be in its most forward position.

As described above, the valve 219 may be used by itself to control both discharge actuation and output selection, however it may also be used in conjunction with a separate discharge actuating valve or pump, such that valve 219 and trigger lever 215 are employed for output selection only. It may be noted that valve outputs 238*a–c* are mutually exclusive in Positions 1, 2 and 4, but are all enabled in Position 5. This allows the section of individual discharge paths, or the selection of all paths simultaneously, without the need for check valves or redundant nozzles and conduits (see FIG. 13 for an example of check valves employed to produce similar results).

Figure 9:
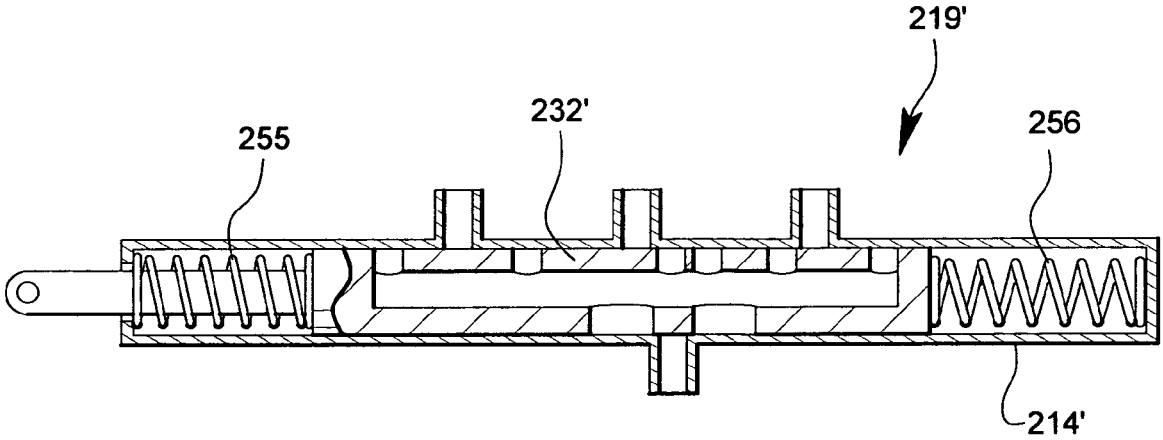
FIG. 9 depicts the five operational positions or modes of the valve of FIGS. 6 and 7.

FIG. 9 illustrates a valve 219' similar to that of FIGS. 7 and 8, modified by the addition of springs 255, 256 which bias plunger 232' to the centered "OFF" position. With such modifications employed in the water gun 210 of FIG. 6, an operator may move trigger handle 228 forward or backward to select any of the available nozzle combinations and initiate discharge, and may cease discharge simply by releasing the handle 228 such that the springs 255, 256 return the valve plunger 232' to the "OFF" mode. The trigger handle 215 may similarly be spring biased to its vertical "OFF" position to assist in or provide for the same result.

Figure 10:
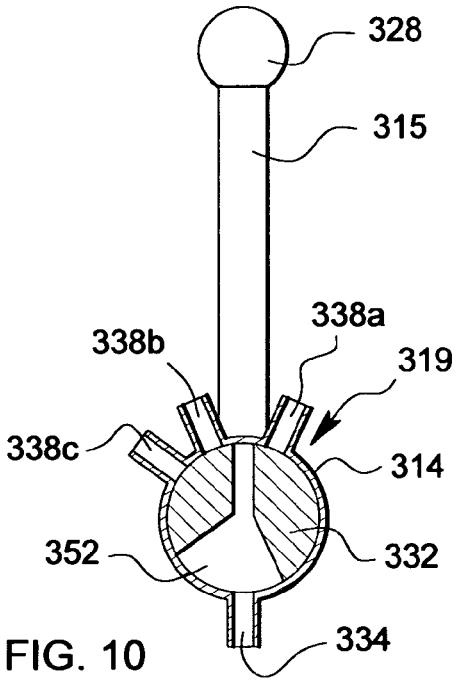
FIG. 10 depicts a control lever and rotary valve, the valve being shown in cross-section, that may be employed in a water gun in accordance with the present invention. The valve and control lever are shown in an "OFF" position, preventing water flow.
Figure 11:
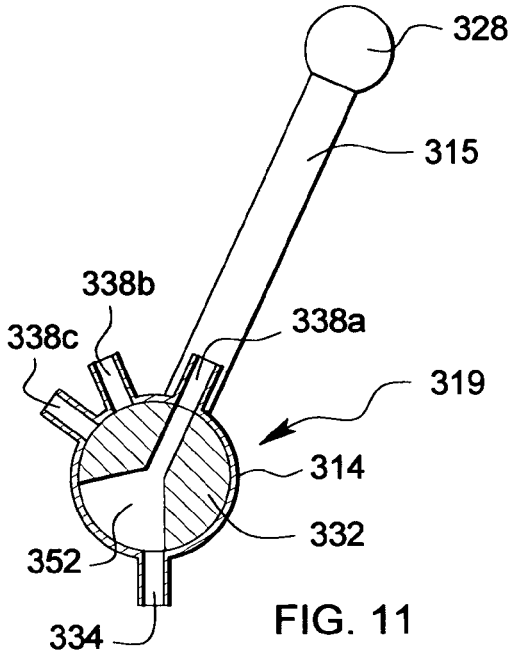
FIG. 11 depicts the control lever and valve assembly of FIG. 10 positioned for flow between a bottom input port and an upper right output port.
Figure 12:
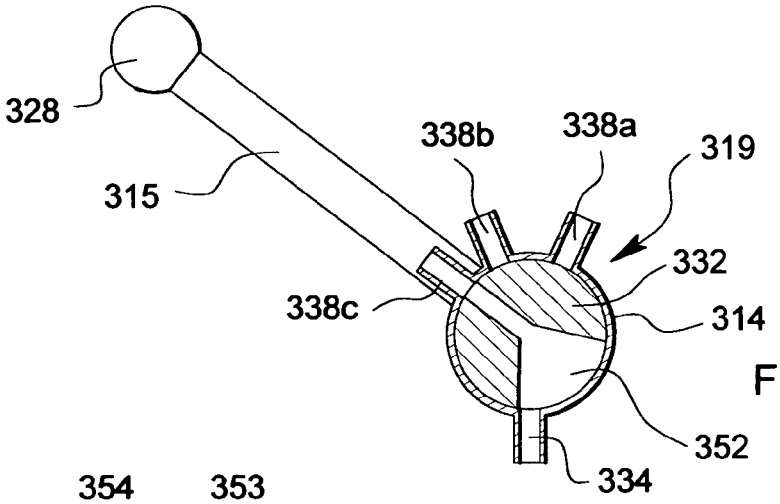
FIG. 12 depicts the control lever and valve assembly of FIG. 10 positioned for flow between the bottom input port and an upper left output port.

FIGS. 10–12 illustrate a multiple output rotary valve 319 that may be employed in a water gun similar to that of FIG. 6. The valve 319 includes a body 314, which is held in fixed position when installed in a water gun, and a core 332 that rotates within the body 314 to block or allow water flow between an input 334 and a selected one of three outputs 338*a–c*. A trigger lever 315 is affixed to the valve core 332 such that as the core rotates with the valve body 314, the lever 315 pivots about a central axis of the valve 319. Thus, the trigger handle 328 is used to rotate the core 332 for operation of the valve.

The valve core includes a central passageway 352 for selective connection of input 334 to outputs 338*a–c*. As depicted in FIG. 10 the passageway 352 is not aligned with an output, so the valve 319 is in an "OFF" mode. The handle 228 may be moved to the right or left, as in FIGS. 11 and 12, to align passageway 352 with outputs 338*a* or 338*c*, respectively, or may be placed in an intermediate position (not shown) to align the passageway with output 338*b*.

Figure 13:
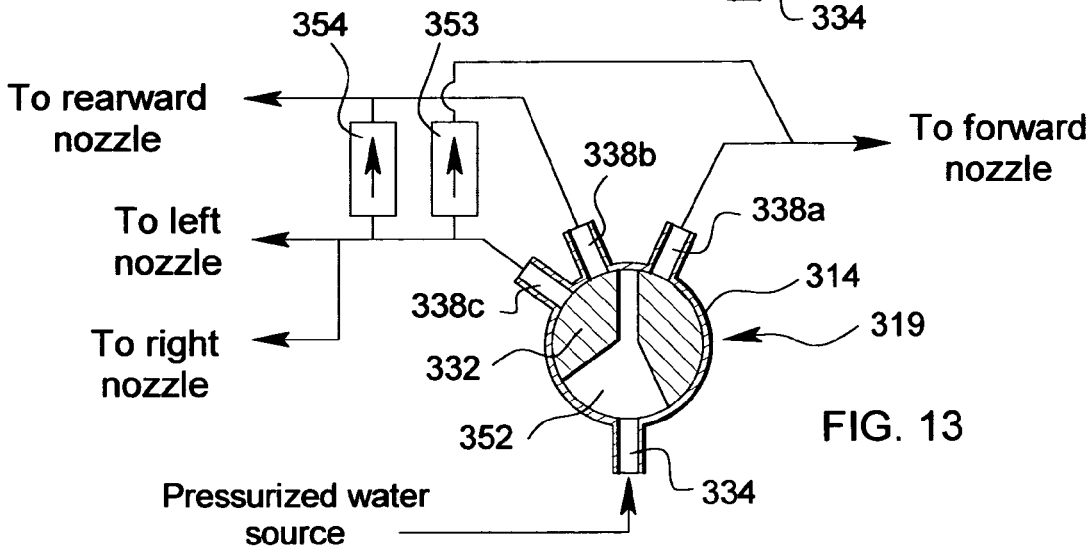
FIG. 13 is a schematic of connections that allow the valve of FIG. 10 to select individual front or rear discharge, or combined front, rear, left and right discharge.

FIG. 13 provides a schematic illustration of connections between the valve 319 and four nozzles that allow for selection of front, rear or four-way discharge. If the core 332 is rotated to allow flow through output 338*a*, water is discharged from the front nozzle, with a unidirectional check valve 353 preventing backflow to the other nozzle paths.

When output 338*b* is selected, water is discharged from the rear nozzle, with a second check valve 354 likewise preventing backflow. When output 338*c* is selected, water flows directly to the left and right nozzles, and additionally flows through check valves 353 and 354, as indicated by arrows, to the rear and front nozzles, for simultaneous discharge in the front, rear, left and right directions. The trigger lever 315 may be biased to the "OFF" position or may be unbiased so that the valve can be left in a selected position.

Figure 14:
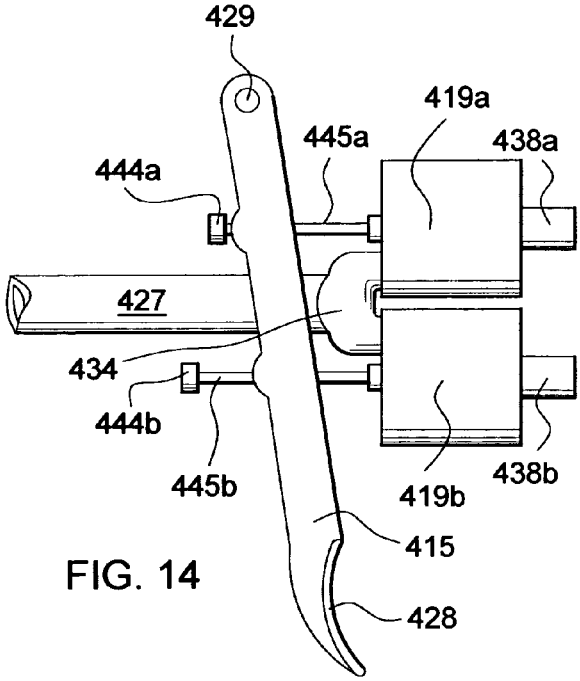
FIG. 14 is a dual valve, single trigger mechanism that may be employed in accordance with the present invention to allow selection of front discharge only, or front discharge combined with a second direction or combination of directions.

FIG. 14 illustrates another trigger and valve mechanism that may be employed in a multiple output water gun such as that of FIG. 2 to provide selectable discharge in multiple directions. Pressurized water is supplied, as has been described for the embodiment of FIG. 1, through a tube 427 and manifold 434, to two valves 419*a, b*. The valves are of a type commonly used in water guns, wherein an internal plunger normally blocks the flow of water and a control rod allows the plunger to be retracted to open the valve, such that water flows from input to output. In the mechanism of FIG. 14, a trigger lever 415, having a finger actuated member 428, is pivoted about a pin 429, such that as the lever 415 is rotated clockwise in the figure, it engages a flange 444*a* on control rod 445*a* to open the first valve 419*a*. The output 438*a* of this valve is attached via conduit to a forward nozzle such as 18*a* in FIG. 2 to provide forward discharge as in a standard single output water gun. As the trigger lever 415 is pivoted farther clockwise, it will engage a flange 444*b* on the control rod 445*b* of the second valve 419*b*, such that both valves are opened. The second valve output 438*b* is connected via conduit to left, right and rear nozzles such as 18*b–d* in FIG. 2, and simultaneous discharge in the front, rear, right and left directions results. Alternatively, the design might be further simplified by omission of the left and right nozzles, so that an operator has only the choices of front discharge or combined front and rear discharge.

Figure 16:
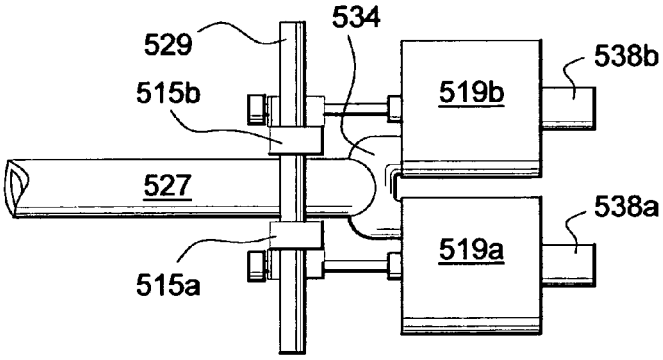
FIG. 16 is a top view of the mechanism of FIG. 15.
Figure 17:
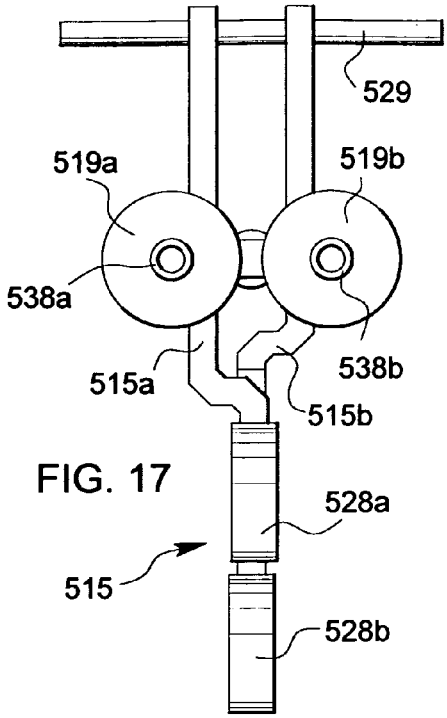
FIG. 17 is a front view of the mechanism of FIG. 15.
Figure 15:
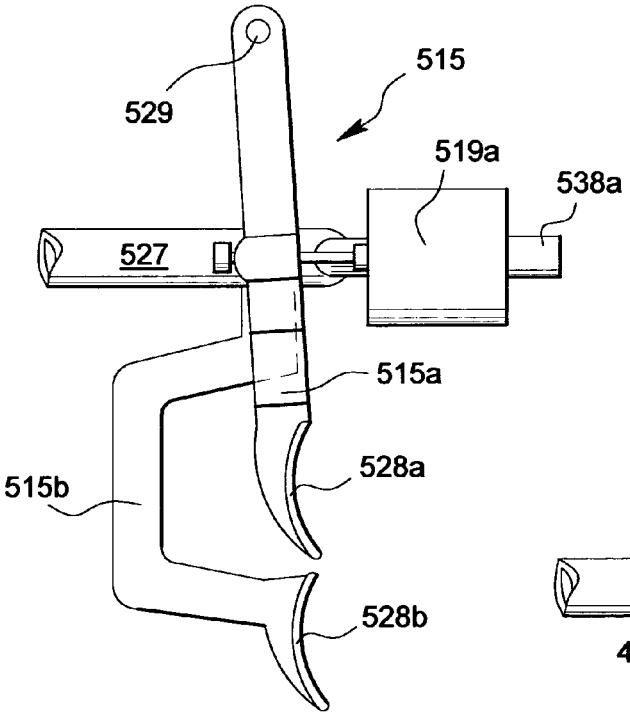
FIG. 15 is a side view of a dual valve, dual trigger mechanism that allows individual selection of two nozzles or groups thereof, or simultaneous selection of both nozzles or nozzle groups.

FIGS. 15–17 provide three views of a more versatile dual valve mechanism, which may be employed in a multiple output water gun like that of FIG. 2. The mechanism incorporates an assembly of two valves 519*a* and 519*b* and a two part trigger 515. The two valves 519*a*, 519*b* are independently actuated by trigger members 515*a* and 515*b*, respectively. The trigger mechanism includes two finger actuated members 528*a* and 528*b*, extending from levers 515*a* and 515*b*, aligned such that an operator can easily operate either or both using the index and middle fingers of one hand. Thus, with first valve output 538*a* connected to a front nozzle and second valve output 538*b* connected to a rear nozzle, an operator may use trigger members 528*a* and 528*b* to selectively actuate front discharge, rear discharge or combined front and rear discharge.

While particular embodiments of the present invention have been shown and described, it will be obvious to those skilled in the art that changes and modifications may be made without departing from this invention in its broader aspects. Notably, while the figures herein have, for convenience of illustration, depicted the invention in conjunction with a sealed reservoir and air pump system for water pressurization, the invention may be likewise practiced with other water pressurizing systems such as electric pumps, manual pumps and expandable bladders.

What is claimed is:

1. A portable toy water gun comprising:

a frame, a reservoir, at least a first nozzle and a second nozzle, and a trigger mechanism;

said frame serving to support elements of said gun and being formed such that said gun generally simulates the appearance of a firearm including a depending grip; said grip oriented in general alignment with a longitudinal vertical plane;

said reservoir adapted to store water to be discharged from said nozzles;

said trigger mechanism having a plurality of operational configurations selectable at the discretion of an operator;

said trigger mechanism in a first operational configuration enabling water to discharge from said first nozzle, but not said second nozzle, said trigger mechanism in a second operational configuration enabling water to discharge from said second nozzle, and said trigger mechanism in a third operational configuration preventing discharge from said first and second nozzles;

said first and second nozzles oriented to discharge water from said water gun in a first generally horizontal direction and a second generally horizontal direction, respectively, with respect to said longitudinal vertical plane;

spatial and directional orientation of said nozzles, relative to said gun and to each other, being substantially unaffected by operation or displacement of said trigger mechanism.

2. The water gun of claim 1, further comprising:

a valve mechanism having at least a first operational mode and a second operational mode corresponding to said first and second operational configurations, respectively, of said trigger mechanism;

said valve mechanism in said first mode conducting water to said first nozzle, but not said second nozzle, and said valve mechanism in said second mode conducting water to said second nozzle.

3. The water gun of claim 1 wherein said trigger mechanism comprises a first trigger and a second trigger;

said first trigger operable to cause discharge of water from said first nozzle;

said first trigger operable independently of said second trigger;

said second trigger operable to cause discharge of water from said second nozzle.

4. The water gun of claim 3 wherein said triggers are located adjacent said grip and are adapted to allow an operator to hold said grip and operate said trigger mechanism with a single hand.

5. The water gun of claim 1 wherein said trigger mechanism comprises a handle carried for linear displacement along an axis whereby a user may select among said operational configurations via linear displacement of said handle along said axis.

6. The water gun of claim 1 wherein said trigger mechanism comprises a handle carried for angular displacement about an axis; said axis generally orthogonal to said longitudinal vertical plane; whereby a user may select among said operational configurations via angular displacement of said handle about said axis.

7. The water gun of claim 1 further comprising a valve; said valve independently operable with respect to the nozzle selecting functions of said trigger mechanism; said valve adapted to selectably block or enable water flow to nozzles selected for discharge by said trigger mechanism.

8. A portable toy water gun comprising:

a frame, a reservoir, a water pressurizing mechanism, a valve mechanism having at least a first output and a second output, and a trigger mechanism interactive with said valve mechanism for operation thereof;

said frame serving to support elements of said gun and being formed such that said gun generally simulates the appearance of a firearm including an elongated barrel portion and a downwardly angled grip; said grip oriented in general alignment with a longitudinal vertical plane;

said trigger mechanism having at least a first operational mode and a second operational mode;

said valve mechanism having at least a first operational mode and a second operational mode corresponding to said first and second operational modes of said trigger mechanism, respectively; said valve mechanism having at least one input and at least first and second outputs;

said input coupled to receive water from said reservoir, pressurized by said pressurizing mechanism;

said valve mechanism in said first mode conducting pressurized water to said first output, and substantially blocking the flow of pressurized water to said second output; said valve mechanism in said second mode conducting water to said second output;

at least a first nozzle and a second nozzle;

said first said output connected to said first nozzle and said second output connected to said second nozzle;

whereby said trigger mechanism in said first mode allows water to discharge from said first nozzle, but not said second nozzle, and said trigger mechanism in said second mode allows water to discharge from said second nozzle;

said first and second nozzles oriented to discharge water from said water gun in a first generally horizontal direction and a second generally horizontal direction, respectively, with respect to said longitudinal vertical plane;

spatial and directional orientation of said nozzles, relative to said gun and to each other, being substantially unaffected by operation or displacement of said trigger mechanism.

9. The water gun of claim 8 wherein said second operational mode of said trigger mechanism allows simultaneous discharge from said first and second nozzles.

10. The water gun of claim 8 wherein said second operational mode of said trigger mechanism prevents discharge from said first nozzle.

11. The water gun of claim 8 wherein said trigger mechanism has a third operational mode; said third mode preventing discharge from said first and second nozzles.

12. The water gun of claim 8 wherein said trigger mechanism comprises a first trigger and a second trigger;

said first trigger operable to cause discharge of water from said first nozzle;

said first trigger operable independently of said second trigger;

said second trigger operable to cause discharge of water from said second nozzle.

13. The water gun of claim 12 wherein said triggers are located adjacent said grip and are adapted to allow an operator to hold said grip and operate said trigger mechanism with a single hand.

14. The water gun of claim 8 wherein said valve mechanism comprises a first valve and a second valve;

said first valve operable to conduct water to said first nozzle and said second valve operable to conduct water to said second nozzle.

15. The water gun of claim 8 wherein said trigger mechanism comprises a handle carried for linear displacement along an axis whereby a user may select among said operational modes via linear displacement of said handle along said axis.

16. The water gun of claim 8 wherein said trigger mechanism comprises a handle carried for angular displacement about an axis; said axis generally orthogonal to said longitudinal vertical plane; whereby a user may select among said operational modes via angular displacement of said handle about said axis.

17. The water gun of claim 8 wherein said valve mechanism comprises a first valve and a second valve; said first valve operable for selectably blocking or enabling water flow to said second valve; said second valve operable via said trigger mechanism for selection of nozzles from which water is to be discharged.

18. A portable toy water gun comprising:

a frame, a water reservoir, at least a first nozzle and a second nozzle, a handle, and at least a first valve;

said frame serving to support elements of said gun and being formed such that said gun generally simulates the appearance of a firearm including a barrel portion and a grip angled therefrom in general alignment with a longitudinal vertical plane;

said valve comprising a body and a core; said core movably disposed within said body; said body comprising at least a first output port and a second output port;

said handle movably positioned to the exterior of said frame and operatively linked to said valve such that a user may manipulate said handle to move said core within said valve body;

said core having at least a first position and a second position relative to said body;

said core in said first position allowing water to flow through said valve to said first output port, but not said second output port, and said core in said second position allowing water to flow through said valve to said second output port;

said first valve output port connected to said first nozzle and said second valve output port connected to said second nozzle, such that flow through said valve to said first and second output ports results in discharge from said first and second nozzles, respectively;

said nozzles oriented to project water from said gun in general alignment with a horizontal plane.

19. The water gun of claim 18 wherein said second position of said core allows simultaneous flow to said first and second output ports, for simultaneous discharge from said first and second nozzles.

20. The water gun of claim 18 wherein said second position of said core prevents flow through said valve to said first output port, and thereby prevents discharge from said first nozzle.

21. The water gun of claim 18 wherein said core has a third position relative to said body;

said third position preventing flow through said valve to said first and second output ports, thereby preventing discharge from said first and second nozzles.

22. The water gun of claim 18 wherein said second position of said core prevents flow through said valve to said first output port, and further comprising a check valve adapted for unidirectional flow; said check valve operably connected between said valve outputs and said nozzles to allow flow from said second output port to said first nozzle and to prevent flow from said first output port to said second nozzle.

23. The water gun of claim 18 further comprising a third nozzle, and wherein said valve body has a third output port and said valve core has a third position relative to said body; said third output port operably connected to said third nozzle; said core in said third position allowing water to flow through said valve to said third output port, for discharge from said third nozzle.

24. The water gun of claim 18 further comprising a third nozzle; said first nozzle being aimed in a first direction with respect to said gun; said second and third nozzles being oriented to aim in second and third directions, respectively, which diverge from said first direction in generally equal and opposite angular relationship.

25. The water gun of claim 24 wherein said third nozzle is in fluid communication with said second valve output port, such that said core in said second position allows simultaneous discharge from said second and third nozzles.

26. The water gun of claim 25 further comprising a fourth nozzle, and wherein said valve body has a third output port and said valve core has a third position relative to said body; said third output port operably connected to said fourth nozzle; said core in said third position allowing water to flow through said valve to said third output port, for discharge from said fourth nozzle; said fourth nozzle being positioned on said gun to project water therefrom in a direction generally opposite said first direction.

27. The water gun of claim 18 wherein said first and second nozzles project water in generally opposite directions.

28. The water gun of claim 27 wherein said water gun is generally elongated in form, having a first end and a second end; said first nozzle located at or about said first end and said second nozzle located at or about said second end.

29. The water gun of claim 28 wherein said gun is adapted in form such that in normal operation said first end and said first nozzle protrude and discharge generally forward of an operator's body and such that said second end and said second nozzle protrude and discharge generally to the rear of an operator's body.

30. The water gun of claim 18 wherein said handle is carried for linear displacement along an axis whereby a user may select among said valve core positions via linear displacement of said handle along said axis.

31. The water gun of claim 18 wherein said handle is carried for angular displacement about an axis; said axis generally orthogonal to said longitudinal vertical plane; whereby a user may select among said valve core positions via angular displacement of said handle about said axis.

32. The water gun of claim 18 further comprising a second valve; said second valve independently operable with respect to the nozzle selecting functions of said first valve; said second valve adapted to selectably block or enable water flow to said first valve.

33. A portable toy water gun comprising:

a frame, a reservoir, a handle mechanism, a first nozzle and a second nozzle;

said frame serving to support elements of said gun and being formed such that said gun generally simulates the appearance of a firearm including a barrel portion and a grip angled therefrom in general alignment with a longitudinal vertical plane;

said handle mechanism having first and second modes of operation selectable at the discretion of an operator; said first mode allowing water to discharge from said first nozzle and not from said second nozzle, said second mode allowing water to discharge from said second nozzle and not from said first nozzle;

said nozzles oriented to project water from said gun in general alignment with a horizontal plane;

spatial and directional orientation of said nozzles, relative to said gun and to each other, being substantially unaffected by operation or displacement of said handle mechanism.

34. The water gun of claim 33 wherein said handle mechanism has a third mode of operation; said third mode allowing simultaneous discharge of water from said first and second nozzles.

35. The water gun of claim 33 wherein said nozzles aim in different directions with respect to one another.

36. The water gun of claim 33 wherein said nozzles have differently sized orifices with respect to one another.

37. The water gun of claim 33 wherein said nozzles have different spray patterns with respect to one another.

38. The water gun of claim 33 wherein said handle mechanism comprises a first trigger and a second trigger;

said first trigger operable to cause discharge of water from said first nozzle;

said first trigger operable independently of said second trigger;

said second trigger operable to cause discharge of water from said second nozzle.

39. The water gun of claim 38 wherein said triggers are located adjacent said grip and are adapted to allow an operator to hold said grip and operate said handle mechanism with a single hand.

40. The water gun of claim 33 wherein said handle mechanism comprises a trigger carried for linear displacement along an axis whereby a user may select among said modes of operation via linear displacement of said trigger along said axis.

41. The water gun of claim 33 wherein said handle mechanism comprises a trigger carried for angular displacement about an axis; said axis generally orthogonal to said longitudinal vertical plane; whereby a user may select among said modes of operation via angular displacement of said trigger about said axis.

42. The water gun of claim 33 further comprising a valve; said valve independently operable with respect to the nozzle selecting functions of said handle mechanism; said valve adapted to selectably block or enable water flow to nozzles selected for discharge by said handle mechanism.

43. A portable toy water gun comprising:

a frame, a reservoir, a valve, a handle, a first nozzle and a second nozzle;

said frame serving to support elements of said gun and being formed such that said gun generally simulates the appearance of a firearm including a barrel portion and a grip angled therefrom in general alignment with a longitudinal vertical plane;

said valve having an output member and a supply member movable relative one another;

said output member having at least two outputs ports;

said supply member comprising at least one passageway for conducting water to at least one said output port;

said valve having at least two modes of operation corresponding to different relative positions of said output member and said supply member;

said handle operatively linked with said valve whereby a user may select among said valve modes of operation via manipulation of said handle;

a first valve mode allowing water to flow from a first output of said valve for discharge from said first nozzle and not from said second nozzle, a second valve mode allowing water to flow from a second output of said valve for discharge from said second nozzle;

said nozzles oriented to project water from said gun in general alignment with a horizontal plane;

positioning of said nozzles on said gun being unaffected by operation of said handle.

44. The water gun of claim 43 wherein said handle is in the form of a trigger.

45. The water gun of claim 43 wherein said second mode of valve operation allows simultaneous flow of water from said valve outputs to said first and second nozzles.

46. The water gun of claim 43 wherein said second mode of valve operation prevents flow of water from said valve to said first nozzle.

47. The water gun of claim 43 wherein said valve has a third mode of operation; said third mode preventing flow of water from said valve to said first and second nozzles.

48. The water gun of claim 43 wherein said valve output member is stationary and said supply member is movable, both relative to said gun; said handle being operable by a user to change the position of said supply member relative to said gun.

49. The water gun of claim 43 wherein said handle has a plurality of operational positions; each said handle position corresponding to a different one of said valve modes.

50. The water gun of claim 43 wherein reciprocative actuation of said handle causes incremental sequencing among said valve modes.

51. The water gun of claim 43 wherein said handle is carried for linear displacement along an axis whereby a user may select among said valve modes via linear displacement of said handle along said axis.

52. The water gun of claim 43 wherein said handle is carried for angular displacement about an axis; said axis generally orthogonal to said longitudinal vertical plane; whereby a user may select among said valve modes via angular displacement of said handle bout said axis.

53. A portable toy water gun comprising:

a frame, a reservoir, first and second nozzles, a gate mechanism and a trigger;

said frame serving to support elements of said gun and being formed such that said gun generally simulates the appearance of a firearm including an elongated barrel portion and a downwardly angled grip; said grip oriented in general alignment with a longitudinal vertical plane;

said gate mechanism comprising a plurality of passages which may be opened or closed to regulate the flow of water from said reservoir to said nozzles;

said trigger having first and second operational modes;

said first operational mode of said trigger opening a passage of said gate mechanism whereby water may be conducted to said first nozzle and not said second nozzle;

said second operational mode of said trigger opening a passage of said gate mechanism whereby water may be conducted to said second nozzle;

said first and second nozzles oriented to discharge water from said water gun in a first generally horizontal direction and a second generally horizontal direction, respectively, with respect to said longitudinal vertical plane;

spatial and directional orientation of said nozzles, relative to said gun and to each other, being substantially unaffected by operation or displacement of said trigger mechanism.

54. The water gun of claim 53 further comprising a third nozzle oriented to discharge water in a third direction; said trigger operable to open a passage of said gate mechanism whereby water may be conducted to said third nozzle.

55. A portable toy water gun comprising:

a reservoir, a valve, a handle, a first nozzle and a second nozzle;

said valve having an output member and a supply member;

said reservoir functionally coupled in said gun whereby said supply member may be provided with water;

said output member having at least first and second output ports;

said supply member comprising at least one passageway for conducting water to at least one said output port;

said output member and said supply member being adapted for linear motion relative to one another along an axis;

said valve having at least first and second modes of operation corresponding to different relative positions of said output member and said supply member in alignment with said axis;

said handle operatively linked with said valve whereby a user may select among said valve operating modes by altering the relative linear positioning of said valve members via manipulation of said handle;

said first valve mode allowing water to flow from said first output of said valve for discharge from said first nozzle and not from said second nozzle; said second valve mode allowing water to flow from said second output of said valve for discharge from said second nozzle.

56. The water gun of claim 55 wherein said first valve mode allows water to flow from said first output port and not from said second output port, and wherein said second valve mode allows flow from said second output port and not from said first output port.

57. The water gun of claim 55 wherein said first valve mode allows water to flow from said first output port and not from said second output port, and wherein said second valve mode allows simultaneous flow from said second output port and from said first output port.

58. The water gun of claim 55 wherein said handle is carried for linear displacement along an axis whereby a user may select among said valve modes via linear displacement of said handle along said axis.

59. The water gun of claim 55 wherein said handle is carried for angular displacement about an axis; said axis generally orthogonal to said longitudinal vertical plane; whereby a user may select among said valve modes via angular displacement of said handle about said axis.

60. A portable toy water gun comprising:

a reservoir, at least one trigger, a first nozzle and a second nozzle;

said gun having a front end and a rear end;

said first nozzle being supported generally on or about said front end and oriented to project water forwardly with respect to said gun;

said trigger being supported generally intermediate said front and rear ends;

said second nozzle being located on or about said rear end and oriented to project water in a generally rearward direction;

said rear end being substantially elongated and extending rearwardly with respect to the location of said trigger such that in normal operation said second nozzle will be positioned to project water both rearwardly and away from an operator;

said trigger operable to discharge water from said second nozzle.

61. The water gun of claim 60 wherein said trigger is operable to discharge water from said first nozzle.

62. The water gun of claim 61 wherein said trigger has a plurality of operational modes whereby water may be discharged from said first and second nozzles individually or in combination.

63. The water gun of claim 62 wherein said trigger comprises a first member and a second member; said first member being independently operable to discharge water from said first nozzle only; said second member being independently operable to discharge water from said second nozzle only; said first and second members being operable simultaneously for simultaneous discharge from said first and second nozzles.

64. The water gun of claim 60 further comprising a second trigger; said second trigger operable to discharge water from said first nozzle.

65. The water gun of claim 61 further comprising a third nozzle and a fourth nozzle, and having a left side and a right side relative to said front and rear ends; said third nozzle oriented to project water generally to the left and said fourth nozzle oriented to project water generally to the right; said trigger operable to selectively cause or allow discharge of water from said nozzles or predetermined combinations thereof.

66. A portable toy water gun comprising:

a reservoir, at least one trigger, and at least first, second and third nozzles;

said gun having a front end and a rear end, a left side and a right side;

said first nozzle oriented to project water in a forward direction with respect to said gun;

said second nozzle oriented to project water in a leftward direction with respect to said gun;

said third nozzle oriented to project water in a rightward direction with respect to said gun;

said trigger having at least a first operational position and a second operational position;

said trigger in said first operational position enabling water discharge from said first nozzle and not from said second and third nozzles;

said trigger in said second operational position enabling discharge from said second nozzle.

67. The water gun of claim 66 wherein said trigger in said second operational position enables simultaneous discharge from said second and third nozzles.

68. The water gun of claim 66 wherein said trigger in said second operational position enables simultaneous discharge from said first, second and third nozzles.

69. The water gun of claim 66 further including a third trigger position and a fourth nozzle;

said fourth nozzle oriented to project water in a rearward direction with respect to said gun;

said third trigger position enabling discharge from said fourth nozzle.

70. The water gun of claim 69 wherein said third trigger position enables simultaneous discharge from said first, second, third and fourth nozzles.

71. The water gun of claim 68 further including a third trigger position wherein discharge from said first, second and third nozzles is prevented.

72. The water gun of claim 67 further comprising a valve; said valve independently operable with respect to the nozzle selecting functions of said trigger; said valve adapted to selectably block or enable water flow to nozzles selected for discharge by said trigger.

* * * * *